US005788103A

United States Patent [19]

Wagner et al.

[11] Patent Number: 5,788,103

[45] Date of Patent: Aug. 4, 1998

[54] CONTAINER BASE

[75] Inventors: Leslie A. Wagner, Auburn; Greg M. Dziak, Graham, both of Wash.

[73] Assignee: Perstorp Xytec, Inc., Tacoma, Wash.

[21] Appl. No.: 882,244

[22] Filed: Jun. 25, 1997

Related U.S. Application Data

[63] Continuation of Ser. No. 620,877, Mar. 22, 1996, abandoned.

[51] Int. Cl.[6] ..... B65D 6/22

[52] U.S. Cl. ..... 220/6; 220/666; 206/600

[58] Field of Search ..... 220/6, 7, 666; 206/386, 600

[56] References Cited

U.S. PATENT DOCUMENTS

| | | | |
|---|---|---|---|
| 4,044,910 | 8/1977 | Box | 220/6 |
| 4,693,386 | 9/1987 | Hughes et al. | 220/6 |
| 5,161,709 | 11/1992 | Oestreich, Jr. | 220/6 |
| 5,231,808 | 8/1993 | Angelette | 206/386 |
| 5,467,885 | 11/1995 | Blinstrub | 220/6 |

*Primary Examiner*—Stephen J. Castellano

*Attorney, Agent, or Firm*—Townsend and Townsend and Chew LLP

[57] ABSTRACT

A container base for use with a collapsible container includes a base surface coupled to and surrounded by a number of base wall structures. Each of the base wall structures is constructed with an interior and an exterior wall. The interior wall of each base wall is coupled to the base surface. The interior and exterior walls each have substantially smooth surfaces without ribbing or other reinforcement.

13 Claims, 3 Drawing Sheets

CONTAINER BASE

This is a Continuation of application Ser. No. 08/620,877, filed Mar. 22, 1996 now abandoned, the disclosure of which is incorporated by reference.

BACKGROUND OF THE INVENTION

The present invention relates to a base design for containers. In particular, the present invention relates to designs suitable for use with collapsible containers.

A number of shipping and storage containers having hinged or otherwise collapsible sidewalls have been proposed. These collapsing sidewalls provide the ability to reduce the volume required for such containers during storage or initial shipment and, for reusable containers, during return-shipment. These collapsible containers place great demands on the base of the container, as loads normally distributed through the sidewalls must be accommodated by the base. To accommodate the extra load requirements, previous base designs bolstered the stiffness and strength of the base by adding support beams and waffle plates. These containers are generally formed from injection-molded plastics, such as high-density polyethylene. Examples of typical ribbing and beam patterns used to reinforce bases for collapsible containers are shown in U.S. Pat. Nos. 4,674,647, issued Jun. 23, 1987 to Gyenge et al; 4,775,068, issued Oct. 4, 1988 to Reiland et al.; and 5,114,037, issued May 19, 1992 to Hillis et al. Generally, previous container base designs for heavy loads required a beam placed along the load bearing surface in addition to ribbing or waffle plates formed along exterior surfaces of the base.

While these reinforcement techniques produce high strength container bases with large load capacities, they have several disadvantages. First, the beam tends to obstruct the forklift openings, making it difficult to quickly place a forklift under the container. Further, the designs having reinforcing beams or waffle plates tend to be very rigid. Plastic products which are rigid tend to fail easier when impacted. For example, a rigid beam positioned at the base of a container may be impacted during transport, e.g., by a forklift or by another container. This causes the plastic to deteriorate or fail. Stiff plastic products are not very impact abuse resistant. It would be desirable to provide a design which does not require a stiff plastic base reinforced with waffle plates or a beam. Further, it would be desirable to provide a container base which is resistant to deterioration from impact.

Another disadvantage of existing collapsible base designs is that the beams and waffle plates used add undesirable weight to the container and increase the amount of plastics required to fabricate a given container. Shipping costs are reduced by reducing the shipping (loaded) and return (empty) weights of these containers. By minimizing the amount of plastics used to create the container base, environmental impact and production costs are also minimized.

Finally, when existing collapsible container bases are used to ship agricultural products and produce, the waffle plates, ribbing, and base tend to become clogged with grime, dirt, or crushed produce. This can raise concerns of sanitation, especially as these reusable container bases are difficult to clean.

There is, therefore, a need for a collapsible container base which can support the heavy loads in agricultural settings while minimizing the amount of material needed to form the base. The base should be resistant to impact damage. Further, the base should be easily cleaned and have relatively smooth surfaces free from pockets or niches which can become clogged with potentially unsanitary matter.

SUMMARY OF THE INVENTION

The present invention includes the recognition of problems in the design of container bases such as bases used with collapsible containers. According to the present invention, a container base for use with a collapsible container is provided which includes a base surface coupled to and surrounded by a number of base wall structures. Each of the base wall structures is constructed with an interior and an exterior wall. The interior wall of each base wall is coupled to the base surface. The interior and exterior walls each have substantially smooth surfaces.

A number of legs are provided to support the base. These legs are formed from the exterior walls of the base wall structures. The result is a container base which may be used with collapsible containers which does not require waffle plates or support beams. Further, the double wall design is resistant to failure due to point impacts (such as from tips of forklifts), as the double wall is somewhat resilient. The design uses up to 25% less plastics material than previous designs which used waffle plates and/or support beams, yet the design is suitable for heavy load applications. As less material is used, the bases weigh significantly less than previous designs. Further, because the internal and external walls are substantially smooth, they are easy to clean and relatively sanitary, making them well-suited for the transport of produce.

Additional advantages to bases designed according to the present invention include the ability to efficiently stack containers in a smaller area than was previously possible, and a less labor intensive manufacturing process than required for previous container base designs.

For a fuller understanding of the nature and advantages of the invention, reference should be made to the ensuing description taken in conjunction with the accompanying drawings.

DESCRIPTION OF SPECIFIC EMBODIMENTS

Figure 1:
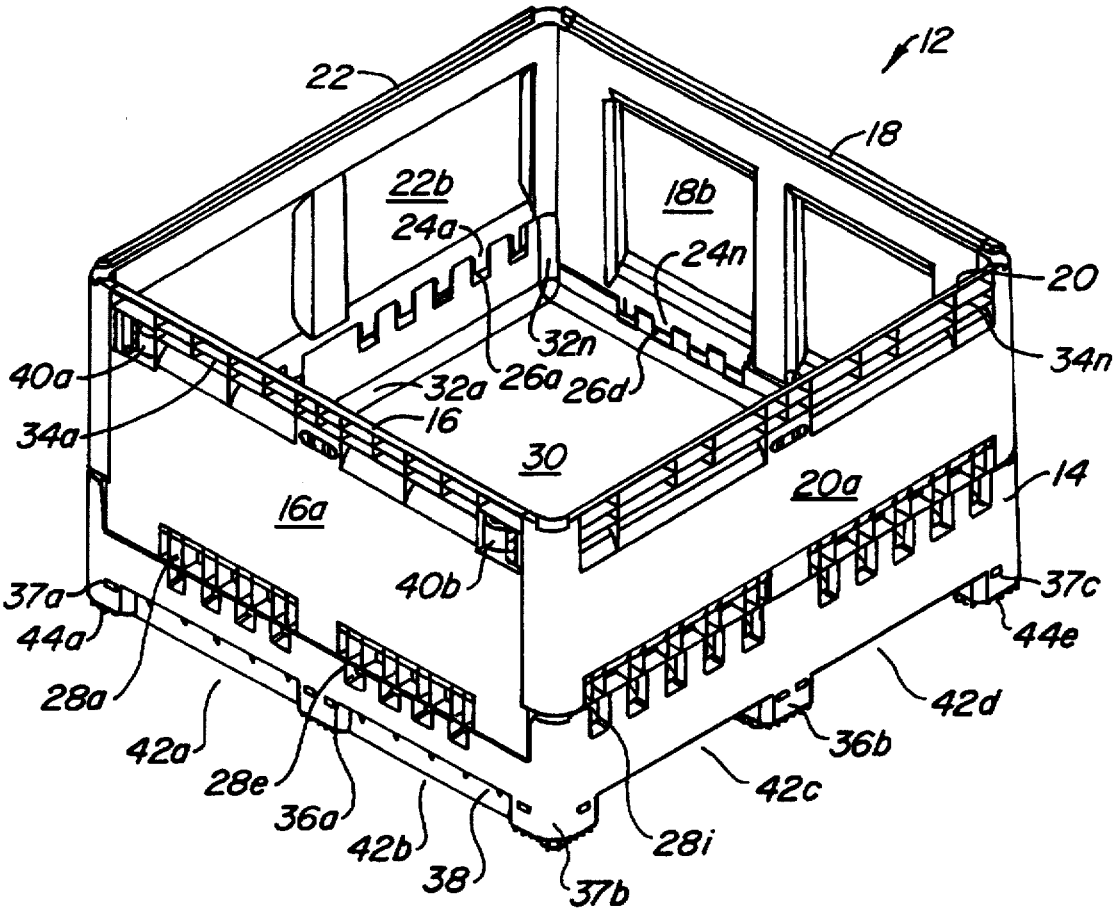
FIG. 1 is a perspective view of a container having a base according to one embodiment of the invention.

As seen in FIG. 1, a container 12 includes a base portion 14, two tall sidewalls 16, 18 and two short sidewalls 20, 22. The container can be made of a number of materials, preferably the entire container 12 is formed by injection-molding plastic techniques. This structure is most advantageously formed with a material such as high-density polyethylene. Preferably, the exterior surfaces **16*a*, 18*a*, 20*a*, 22*a* and the interior surfaces 16*b*, 18*b*, 20*b*, and 22*b* of the sidewalls and the container floor 30** are smooth and free of obstructions so as to be easily cleaned and prevent damage to sensitive contents such as produce. These surfaces are preferably substantially smooth; that is, these surfaces are preferably formed without any raised ribbing or other reinforcements which would tend to collect grime and dirt and which make the walls very rigid and subject to failure.

Each of the sidewalls 16, 18, 20, 22 may be coupled to the base portion 14 via hinges 24, 26, 28, and 30. In the embodiment depicted in FIG. 1, the sidewalls 16, 18, 20, 22 are non-integral with respect to each other, preferably being separately molded and are also non-integral with respect to the base section 14. The sidewalls are secured in an upright configuration using latches 4O*a–d*. In one embodiment, the tall sidewalls 16, 18 can be moved by pivoting from the upright configuration depicted in FIG. 1 to a collapsed configuration with the first and second sidewall 16, 18 lying adjacent the base portion 14. Also in this embodiment, the short sidewalls 20, 22 can be moved from the upright configuration depicted in FIG. 1 to a collapsed configuration to lie on top of the previously-moved tall sidewalls 16, 18, to provide a compact and more easily transported container, e.g., for return (empty) shipment. When a collapsible container is provided, a number of hinge types can be used to form hinges 24*a–n*. In the embodiment depicted, the hinges 24*a–n* are formed as a part of the sidewalls 16–22. Each hinge 24 pivots about a pin 26*a–n* within a hinge pocket 28*a–n* formed in the base portion 14.

A number of vents 34*a–n* may be provided to encourage air circulation throughout the container. In the embodiment depicted, the vents 34*a–n* are positioned along a top surface of each of the sidewalls 16–22. Other vent locations may also be provided. Thus, most of the surfaces of the container are substantially smooth with the exception of areas formed for ventilation or for hinges which are formed to facilitate cleaning and which do not render the walls unnecessarily rigid.

In these collapsible container configurations, as the sidewalls are not integrally formed, a greater load bearing responsibility is placed on the base portion 14. Base portion 14 includes a container floor 30, center legs 36*a–d*, corner legs 37*a–*37*d*, forklift access holes 42*a–h*. Additionally, as shown in the embodiment depicted in FIG. 1, a forklift strap 38 may be installed along one or more edges of the container base. Leg caps 44*a–h* may be inserted into each leg to seal the legs. The optional forklift strap 38 and leg caps 44*a–h* are designed to fit within the hollow legs 36, 37 thereby plugging the legs to prevent dirt or grime from being lodged within the legs. Further, the forklift strap 38 provides lateral support to the container. Preferably, two forklift straps are installed on opposite sides of the container, providing a base which may be lifted by a forklift from the remaining two sides.

Figure 2:
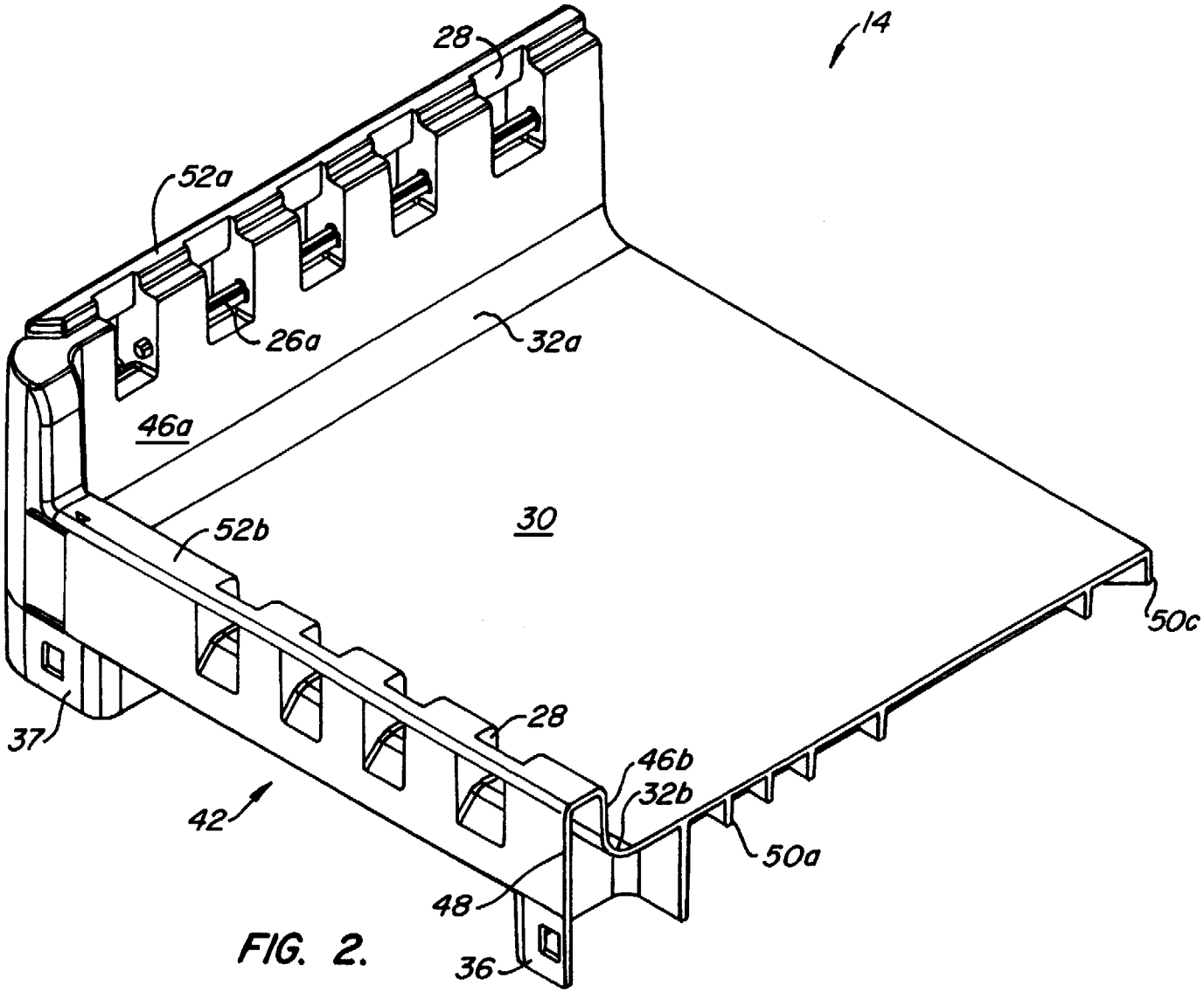
FIG. 2 is a partly cut-away detail of a portion of a base of the device depicted in FIG. 1.

Further details regarding construction of an embodiment of a base 14 according to the present invention will be described by now referring to FIG. 2, where a partial cutaway view of the base portion 14 of the container 12 is shown. Base portion 14 includes a bottom surface 30 which is attached to base interior walls 46*a–d*, preferably via rounded corners 32*a–d*. The base interior walls 46*a–d* rise to a base wall top surface 52*a–d* where they meet a base exterior wall 48*a–d*. Each wall of the base 14 is thus a double wall, including a base interior wall 46 and a base exterior wall 48. Each interior and exterior wall is formed to include a number of hinge pockets 28*a–n* to receive hinges 24*a–n* formed on the sidewalls 16–22. Hinge pins 26*a–d* may be inserted to rotatably attach the hinges 24 to the base 14.

Figure 3A:
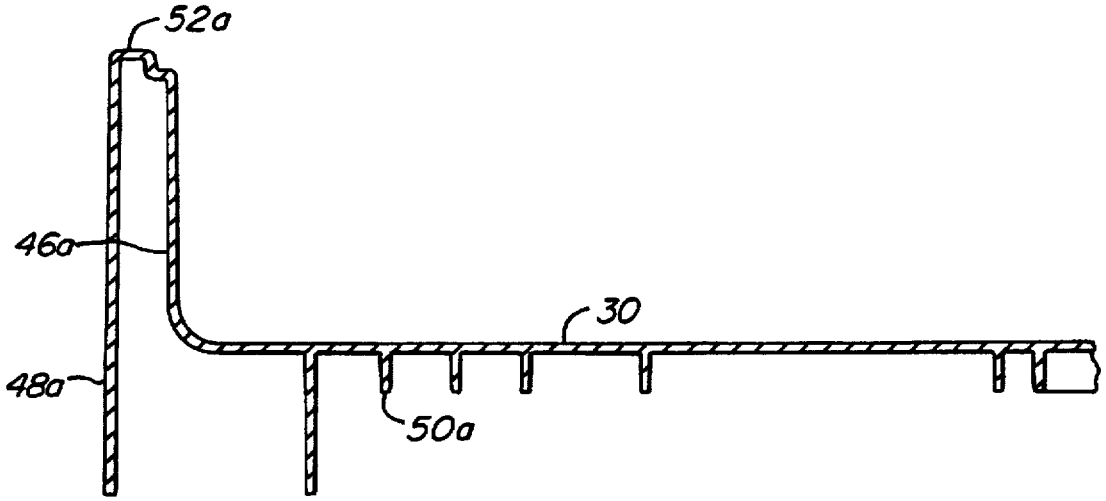
FIGS. 3A and 3B are a cross-sectional views of the double wall of the base of FIGS. 1 and 2.
Figure 3B:
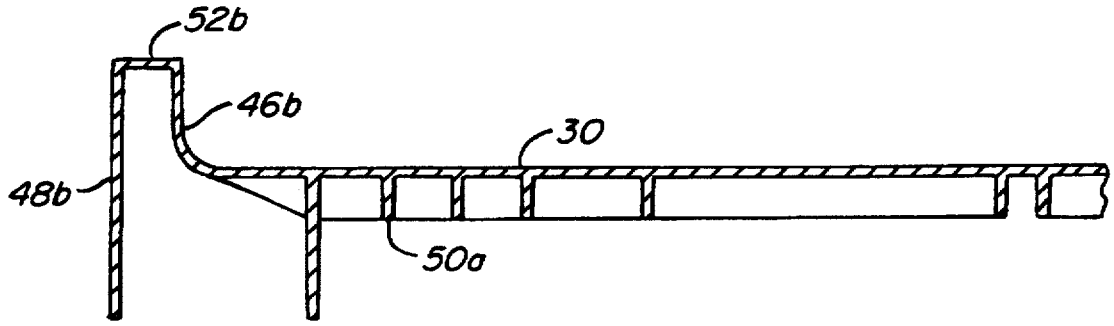

While the base interior walls 46*a–d* merge with the bottom surface 30 of the base 14, the base exterior walls 48*a–d* merge with the corner legs 37*a–d* and the side legs 36*a–d* of the base 14. These interior and exterior walls provide support and stability to the container 12. The walls are shown in further detail in the cross sectional views of FIGS. 3A and 3B. FIG. 3A is a cross sectional view showing the double wall construction formed from base interior wall 46*a* and base exterior wall 48*a*. The base interior wall 46*a* couples to the bottom surface 30 while the base exterior wall 48*a* couples to a leg to provide support and stability to the container. Further support to the base and to the bottom surface 30 of the container is given by providing ribbing 50 beneath the base. These ribbing patterns are known in the art.

In light of the above description, certain advantages are provided by the present invention. Container bases 14 using the double wall construction described above are easily constructed using common plastic molding techniques. The double wall base design is more efficient to produce by: 1) Providing a design with a more uniform cross-sectional thickness. This eliminates over-thick areas of plastic which tend to remain hot after molding and take longer cycle times to produce. Also, thick areas tend to have inherent stress which may have adverse effects on part performance. 2) Efficiency is gained due to absence of external ribs. Elimination of rib junctures promotes laminar flow within the mold cavities, which results in reduced time to fill the mold with plastic.

Container bases 14 constructed with the double wall design described above have been found to employ up to 25% less plastic material than in previous base designs. This reduces the overall weight of the container, reduces the cost of manufacture, and minimizes environmental impact. The double wall construction also is more resistant to impact damage than previous base designs. This is attributable to several aspects of the design. First, container bases 14 according to the present invention do not require cross beams as provided in previous designs which tended to break when impacted with the forklift. By removing the cross beams, while still providing a container base capable of supporting heavy loads, forklift operators are more likely to be able to insert forks and not damage the container, if contacted. Further, the base 14 does not use the rigid waffle and beam design of previous containers. These previous designs relied on the rigidity provided by the waffle plates and beams to support a load. Unfortunately, rigid plastic tends to fail when impacted. The base 14 according to the present invention is not as rigid. Base exterior walls 48*a–d* are instead relatively flexible and are able to absorb greater impacts without failure.

Further, the double walls of the present invention provides a container base which readily stacks on top of other containers. The double walls ensure a positive base-to-top interlock allowing the containers to be stacked up to twelve high.

In one specific embodiment, the container base may be used with sidewalls to provide a container which is 48 by 48 inches and 29 inches high, with an interior depth of 24 inches. The container base 14 may support loads of approximately 1,300 lbs.

A number of variations and modifications of the invention can also be used. Containers can have other forms and shapes than the container depicted in FIG. 1. Vents may be provided along any portion of the sidewalls or bottom surface of the container. Non-skid pads may be installed on each leg to prevent sliding of the container. The forklift access holes may be beveled to provide easy access for a forklift or pallet jack. Labelling zones may be provided along any surface of the base for labelling purposes.

Although the present invention has been described by way of a preferred embodiment and certain variations and modifications, other variations and modifications can also be used, the invention being defined by the following claims.

What is claimed is:

1. A container base for use with a collapsible container, the container base comprising:

a floor member comprising a base surface defining a plane;

a plurality of base wall structures surrounding said base surface;

each of said plurality of base wall structures having a top surface;

an interior wall extending between said top surface and said base surface; and an exterior wall extending to said top surface, each of said interior and exterior walls having a substantially smooth surface; and said floor member and base wall structures being unitarily molded as a one-piece structure.

2. The container base of claim 1 further comprising:

a plurality of legs, each said leg extending from at least one of said exterior walls of said plurality of base wall structures.

3. The container base of claim 2 wherein each of said legs are positioned to form forklift holes.

4. The container base of claim 2 wherein each of said legs are fitted with caps.

5. The container base of claim 1 wherein each of said top surfaces of said plurality of base wall structures is adapted to hingedly mate with a container sidewall.

6. The container base of claim 1 wherein forklift straps are installed along two sides of said container base.

7. A double walled container base, comprising:

a floor;

a base wall assembly extending upwardly from and surrounding said floor;

said base wall assembly having a pair of base end structures; and a pair of base side structures, each of said base end and base side structures having an interior wall extending from said floor to a top portion of each of said base end and base side structures and further having an exterior wall extending to said top portion and spaced apart from said interior wall;

a plurality of downwardly-extending legs supporting said floor and base wall assembly, each of said plurality of legs joined to at least one of said exterior walls of said base side and base end structures; and said floor, base wall assembly and legs being unitarily molded as a one-piece structure.

8. The double walled container base of claim 7 wherein said base wall assembly includes corners and said plurality of legs are positioned at least at said corners of said base wall assembly.

9. The double walled container base of claim 7 wherein each of said interior and exterior walls of said side and end structures are substantially smooth without reinforcement ribbing.

10. A container assembly comprising:

a floor;

a plurality of base walls surrounding said floor, each of said base walls having an inner wall extending to said floor and an outer wall extending to said inner wall at a top edge of each of said base walls, said inner wall and said outer wall forming a double wall base structure;

a plurality of downwardly-extending legs positioned about said plurality of base walls to support said floor and base walls, each of said legs extending partially from an outer wall; and said floor, base wall assembly and legs being unitarily molded as a one-piece structure.

11. The container assembly of claim 10 wherein said plurality of base walls includes a pair of side base walls positioned on opposite sides of said floor and a pair of end base walls positioned on opposite sides of said floor.

12. The container assembly of claim 10 wherein each of said top edges of said plurality of base walls include couplers adapted to hingedly mate with sidewalls.

13. The container assembly of claim 10 further including a pair of sidewalls hingedly mated with said pair of side base walls and a pair of endwalls hingedly mated with said pair of end base walls.

* * * * *